US005941807A

United States Patent [19]

Cassidy et al.

[11] Patent Number: 5,941,807

[45] Date of Patent: Aug. 24, 1999

[54] TORSO MUSCLE AND SPINE EXERCISE APPARATUS

[75] Inventors: Daniel T. Cassidy, 101 S. Forest St., Steubenville, Ohio 43952; Frank J. Eiter, Morganfield, Ky.; Sidney P. Nelson, Griffin, Ind.

[73] Assignee: Daniel T. Cassidy, Irondale, Ohio

[21] Appl. No.: 09/047,790

[22] Filed: Mar. 25, 1998

Related U.S. Application Data

[60] Provisional application No. 60/059,589, Sep. 19, 1997.

[51] Int. Cl.[6] ..... A63B 21/00

[52] U.S. Cl. ..... 482/146; 482/9; 482/130

[58] Field of Search ..... 482/93, 94, 98, 482/99, 102, 103, 112, 113, 129, 130, 146, 147

[56] References Cited

U.S. PATENT DOCUMENTS

| | | | |
|---|---|---|---|
| 3,784,193 | 1/1974 | Simjian . | |
| 3,911,907 | 10/1975 | Smith, Jr. . | |
| 3,936,047 | 2/1976 | Brandt et al. | 482/146 |
| 4,132,405 | 1/1979 | Asher . | |
| 4,296,924 | 10/1981 | Anzaldua et al. . | |
| 4,390,180 | 6/1983 | Simjian . | |
| 4,391,441 | 7/1983 | Simjian . | |
| 4,515,363 | 5/1985 | Schleffendorf . | |
| 4,638,996 | 1/1987 | Simjian . | |
| 4,836,538 | 6/1989 | Rice . | |
| 4,907,796 | 3/1990 | Roel-Rodriguez | 482/146 |
| 4,976,425 | 12/1990 | Barnes, Jr. . | |
| 5,344,376 | 9/1994 | Bostic et al. . | |
| 5,368,535 | 11/1994 | Twardokens . | |
| 5,433,690 | 7/1995 | Gilman . | |
| 5,498,221 | 3/1996 | Blair, Jr. . | |

*Primary Examiner*—John Mulcahy

*Attorney, Agent, or Firm*—Jason H. Foster; Kremblas, Foster, Millard & Pollick

[57] ABSTRACT

A torso, muscle and spine exercise apparatus. A base having upwardly extending tubes into which a handgrippable handle is attached, includes a tiltable, rotatable platform upon which a user stands. The user stands upon the platform and fastens one or more harnesses about his waist or torso. Conventional weight stacks are attached to the harness or harnesses at two or four front points and two or four rear points by a cable and pulley system. Rotation of the user's waist or trunk lifts the weights, causing resistance to rotation. The rotatable platform upon which the user stands can be tilted in any direction to rotate freely about the tilted axis. Exercise of certain portions of the spine may be accomplished by a torso stabilizer belt fastened to the handgrippable handle and extending about the user's chest or waist.

14 Claims, 8 Drawing Sheets

TORSO MUSCLE AND SPINE EXERCISE APPARATUS

This application claims the benefits of U.S. Provisional Application No. 60/059,589 Filed Sep. 19, 1997.

TECHNICAL FIELD

The invention relates to an exercise device, and more specifically to a device for exercising the spinal column and the muscles of the torso, including those in the abdominal, lumbar and thoracic regions.

BACKGROUND ART

The spine is divided into three regions: the cervical, the thoracic and the lumbar. The lumbar region is more commonly referred to as the lower back, and it is this region of the spine, and the muscles attached to the spine, that are associated with common lower back pain and injury. Exercise of the lumbar and thoracic regions, either for rehabilitation or strength enhancement, in a manner that closely simulates natural motion is very desirable for avoiding, and recovering from, injury.

Motion of the spine is made up of components including front to back bending, which are within the sagittal plane, side to side bending, which are in the coronal plane, and rotational movements, which are in the transverse plane. Virtually all motion is made up of components of movement in each of the three planes. When a person injures the spine or muscles associated with it, or wishes to exercise, improve the flexibility of, and mobilize the spine and strengthen associated muscles, the activity should include motion of the spine in all three planes. At some times, however, it is desirable to isolate that portion or plane of motion of the spine or associated muscles which is to be rehabilitated or strengthened, thereby concentrating the rehabilitation or strength-enhancing activity. Furthermore, the rotational component is one component susceptible to injury, and therefore it must be limitable to avoid further injury during any rehabilitation.

Many prior art devices exercise the spine and muscles of the torso by rotating the lower body with respect to the upper body, or vice versa. This enhances motion in the transverse plane, but has a relatively small amount of motion in the sagittal or coronal planes, respectively. Furthermore, this activity is normally undertaken while sitting, which is not the most functional position of the spine and torso muscles.

The need exists for an exercise and rehabilitation device which permits activity consisting of components of motion in all three planes, and permits isolation of a specific area of the body, the motion of which is most desired. Such a device will permit a physical therapist, chiropractor or trainer to tailor the activity of the user to that which is most beneficial for the rehabilitation or strength-enhancing goals of the user.

BRIEF DISCLOSURE OF INVENTION

The invention is an exercise apparatus for a human user's body. "Exercise" includes activity for the purpose of enhancing strength and flexibility and for rehabilitation from injury. The apparatus comprises a platform rotatably mounted to a base. The platform has an axis of rotation which is tiltable relative to the base. The platform is also adapted to receive a weight bearing portion of the user's body, such as the feet. The apparatus further comprises a mechanical force resistor, such as a stack of weights and cables attached to them, connected to the base, and a harness connected to the mechanical force resistor. The harness is for attaching the mechanical force resistor to the user's torso, such as around the pelvic region. The torso is the part of the body excluding the head and appendages.

The apparatus' primary purpose is to resist lower trunk rotation relative to the upper trunk to rehabilitate and strengthen the lumbar spine and abdominal oblique region. The apparatus is also capable of utilizing upper trunk rotation relative to the lower trunk for strengthening, rehabilitating and improving mobility and range of motion of the thoracic spine. The apparatus also mobilizes the thoracic and lumbar spinal joints and improves lumbar and thoracic range of motion.

The present invention retrains and strengthens the lumbar, thoracic, and abdominal region. Lumbar and thoracic rotation requires a force coupling action of both lumbar and abdominal muscles or thoracic and abdominal muscles to perform the action. This apparatus allows the lumbar and thoracic spine to be exercised in all three planes of motion simultaneously, and in a specific group of spinal segments.

Because the platform is tiltable, the spine of the user can be bent forward, backward or to one side, thus emphasizing one plane of motion over another. The user can rotate his or her lower body relative to the upper body, or vice versa. This activity simultaneously works abdominal, lumbar, and thoracic muscles in the way they are anatomically designed to work: on a diagonal or in three dimensions. All movement has a rotational component, and therefore the spine and abdominal muscles need to be worked in a rotational manner. In addition to improving muscular strength and lumbar or thoracic mobility, the invention improves coordination and control.

Figure 1:
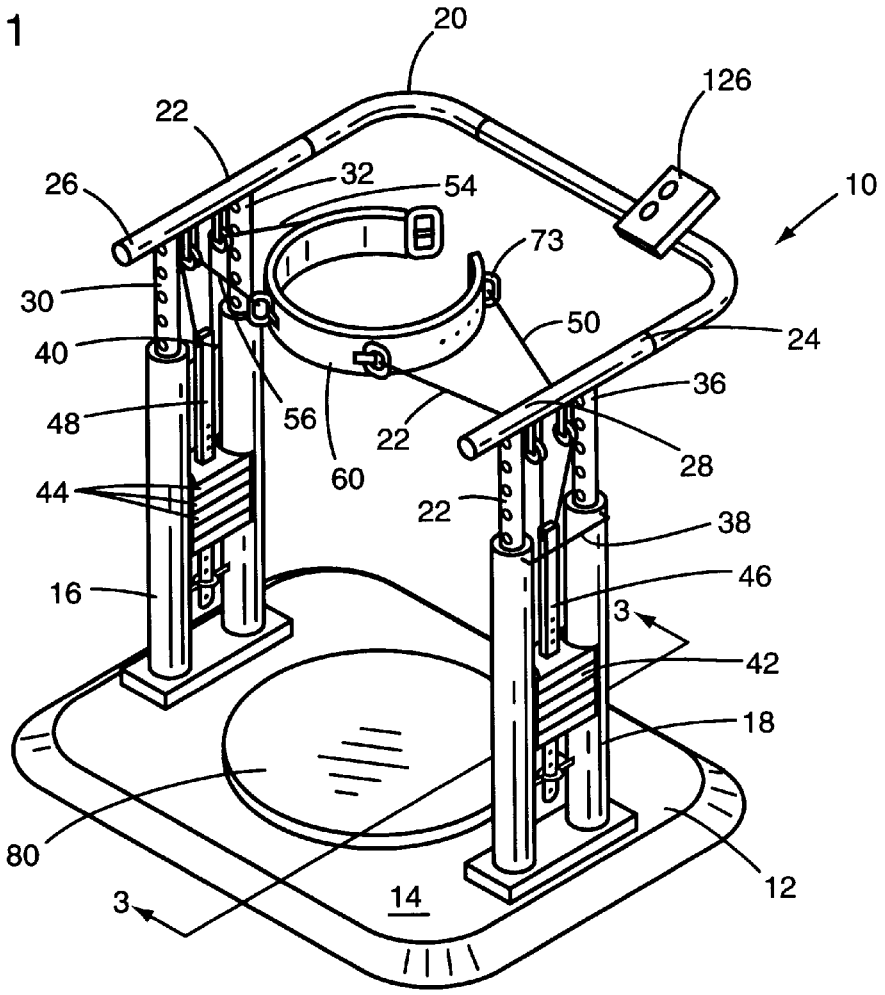
FIG. 1 is a view in perspective illustrating the preferred embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

The preferred exercise apparatus 10 is shown in FIG. 1 in its operable position. A base 12, including a planar panel 14 and upwardly extending column pairs 16 and 18, rests against a floor, or other underlying surface, under the force of gravity. The upright column pairs 16 and 18 preferably consist of two spaced steel tubes fastened to a rectangular plate which is bolted to the panel 14.

A handlebar 20, which is a U-shaped steel bar, attaches at each opposite end to a first pi bar 22 and a second pi bar 24. The bars 22 and 24 are called pi bars because their shapes resemble the greek letter π. Each of the pi bars 22 and 24 has a horizontally extending rod 26 or 28 with two downwardly extending rods 30 and 32 or 34 and 36 rigidly attached thereto. The downwardly extending rods 30–36 extend into openings in the upwardly extending column pairs 16 and 18. Multiple holes extend transversely through each of the downwardly extending rods 30–36 at spaced intervals and are alignable with a single transverse aperture formed at the top of each pipe in the column pairs 16 and 18. "U"-shaped pins 38 and 40 extend through these apertures and also through the holes in the rods 30–36 to maintain the attached handlebar 20 in position.

A mechanical force resistor is attached to the base 12 and a harness 60, which will later attach to a person using the apparatus 10. The mechanical force resistor resists motion of the harness 60 and preferably includes stacked weights 42 and 44 slidably mounted in the gap between the spaced pipes of the column pairs 16 and 18 and resting upon cross members mounted therebetween (not visible in FIG. 1). Vertical pick up bars 46 and 48, which are flat, elongated bars having apertures spaced along their lengths, extend downwardly through aligned, vertical central openings in the weights 42 and 44. The pick up bars 46 and 48 protrude out of the undersides of the weights 42 and 44 and extend through the cross members. A conventional weight stack pin extends through one of the channels formed in each of the weights 42 or 44 and through an aperture in one of the pick up bars 46 or 48. Placement of the weight stack pin determines the number of weights lifted. Cables 50, 52, 54 and 56 attach to the top of each pick up bar 46 and 48 and extend through a pulley system to a harness 60.

Figure 2:
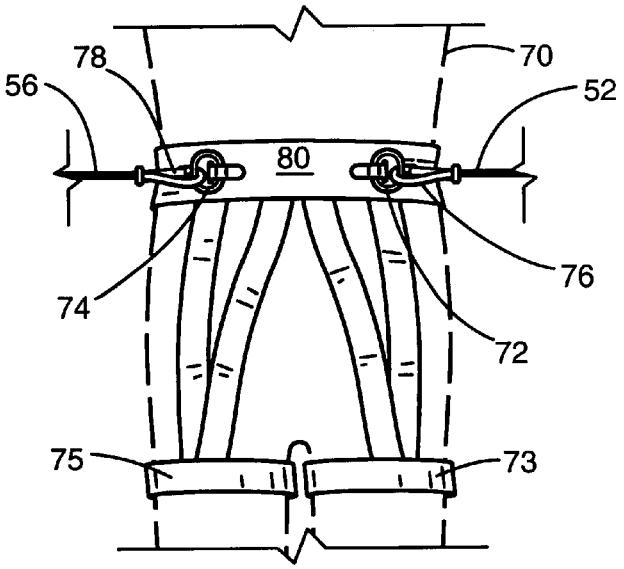
FIG. 2 is a rear view illustrating the preferred harness in its operable position on a human user.

The harness 60 is preferably fastened to the pelvis of a human user, such as the user 70 shown in FIG. 2 when in use. The harness 60 attaches around the pelvis of the user 70 tightly enough that no significant slippage between the harness 60 and the user 70 occurs upon rotation or other motion of the user 70. As an additional rotation preventative measure, leg loops 73 and 75 could extend from the front of the harness 60, down between the legs and to the back of the harness 60.

Rear rings 72 and 74 are fastened to the harness 60, preferably over the SI (Sacro Iliac) joint, by conventional attachment means, and the cables 52 and 56 are connected to the harness 60 by attaching the clasps 76 and 78 to the rings 72 and 74. A second pair of rings 73 and 75 (shown in FIG. 1) is attached to the front of the harness 60, preferably over the ASIS (Anterior Superior Iliac Spine) bone, and the cables 50 and 54 attach to them in a similar manner.

When a tensile force is applied along the cables 50–56, such as by rotation of the pelvis, one or more of the weights 42 and 44 are displaced upwardly. The positioning of the rings 72–75 over the SI joint and ASIS bone directs the force applied to the harness 60 along the direction of the muscles attached to these joints.

Referring again to FIG. 1, the platform 80 is preferably a stainless steel disk having a diameter of approximately 22 inches. The platform 80 is rotatably mounted to the panel 14, and has an upper surface which frictionally engages a weight bearing portion of the body of the user, preferably the soles of the feet or shoes. However, a disabled person or someone using the apparatus in an alternative manner could rest the knees or some other weight bearing body part on the platform 80.

Figure 3:
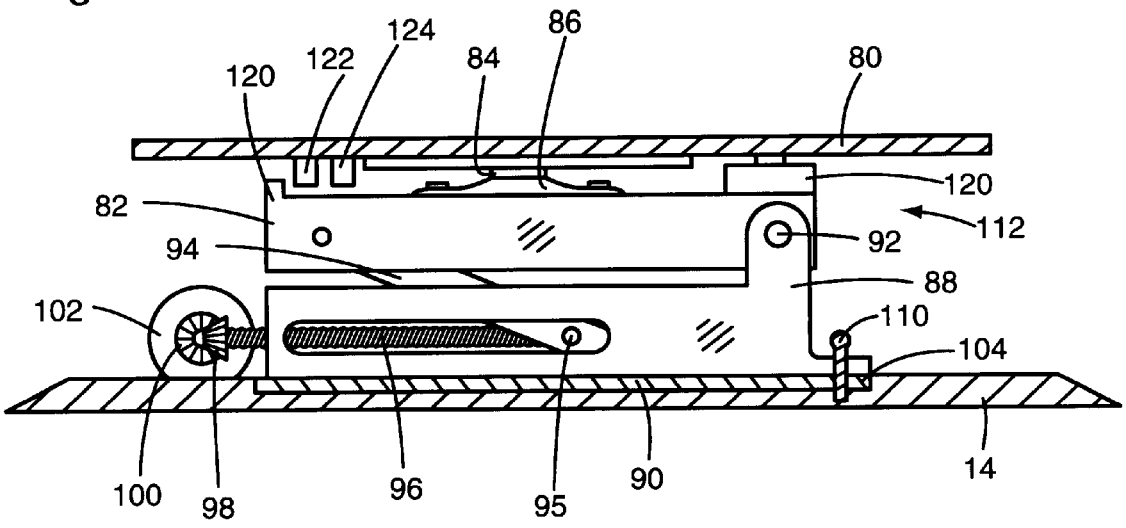
FIG. 3 is a side view in section through the line 3—3 of FIG. 1.

The platform mounting mechanism 112 attaches the platform 80 to the panel 14, and is shown in FIG. 3. The platform 80 is rotatably mounted to a vertically pivotable arm 82 by a shaft 84 extending downwardly from the platform 80 into a bearing 86. In this embodiment, the axis of the shaft 84 forms the axis of rotation of the platform 80. The arm 82 is pivotably mounted to one end of a frame member 88 to permit the arm 82 to be raised from a lowered position (as shown in FIG. 3) to one of many possible raised positions (see for example, FIG. 4).

The arm 82 pivots about the pin 92, raising and lowering the distal, free end by a force applied through the strut 94. The strut 94 is linked to a rotatable, threaded rod 96 through a threaded bore formed in the cylinder 95. The threaded rod 96 can be rotated by the motor 102 through the bevel gears 98 and 100 or a hand crank (not shown). Upon rotation of the driveshaft of the motor 102, or upon rotation of the crank, the threaded rod 96 is rotated, driving the cylinder 95 attached to the lower end of the strut 94 in one direction or the other along the length of the threaded rod 96. This displacement of the cylinder 95 drives the strut 94, pivoting the arm 82 about the pin 92, raising or lowering the free end of the arm 82.

Figure 4:
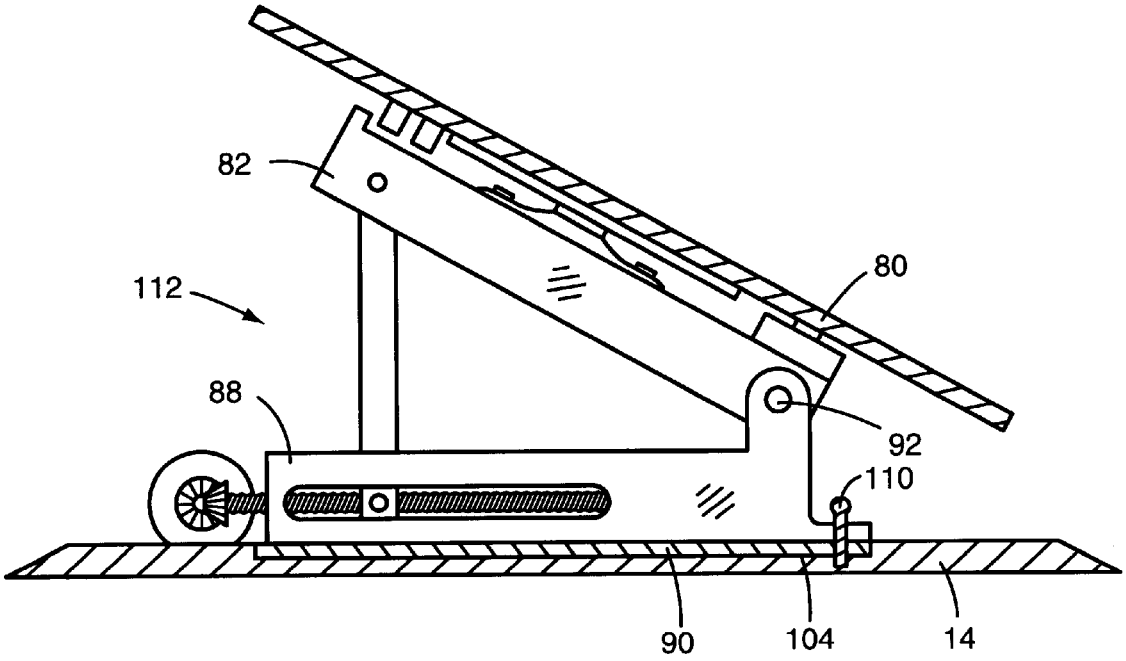
FIG. 4 is a side view in section illustrating the embodiment of FIG. 3 in a tilted position.

Raising the arm 82 tilts the platform 80, and its axis of rotation, from its lowered position shown in FIG. 3 to a tilted position shown in FIG. 4. The degree of tilting can be indicated by a mechanical gauge or can be sensed by an electronic sensor which displays the degree of tilt on the control panel 126.

The circular disk 90, to which the frame 88 is rigidly mounted, is rotatably mounted within a circular recess 104 formed within the panel 14. A pin 110 extends through a transverse aperture in the disk 90 when the aperture registers with one of a plurality of parallel apertures formed in the panel 14. This arrangement permits the platform mounting apparatus 112 to be rotated with respect to the panel 14 and locked into position by extending the pin 110 through the aperture in the disk 90 and a registered aperture in the panel 14.

In FIG. 4, the arm 82 has been pivoted about the pin 92 relative to the frame 88 from its position in FIG. 3. As described above, the disk 90 can be rotated with respect to the panel 14. Therefore, tilting of the platform 80, although possible in only one direction with respect to the frame 88, can be effected in many directions with respect to the panel 14. This is accomplished by pivoting the platform 80 to the desired angle and then rotating the entire platform mounting apparatus 112 with respect to the panel 14 and locking it into the desired position.

Figure 5:
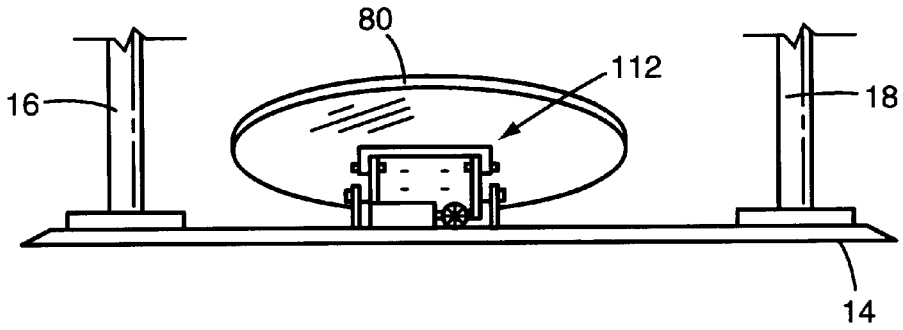
FIG. 5 is a rear view illustrating a frontwardly tilted platform.
Figure 6:
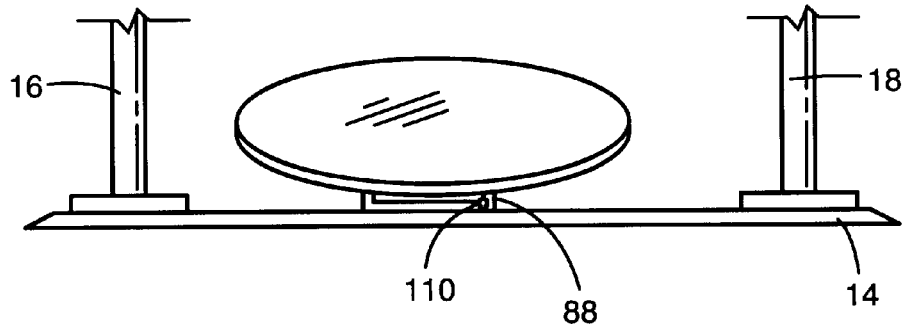
FIG. 6 is a rear view illustrating a rearwardly tilted platform.
Figure 7:
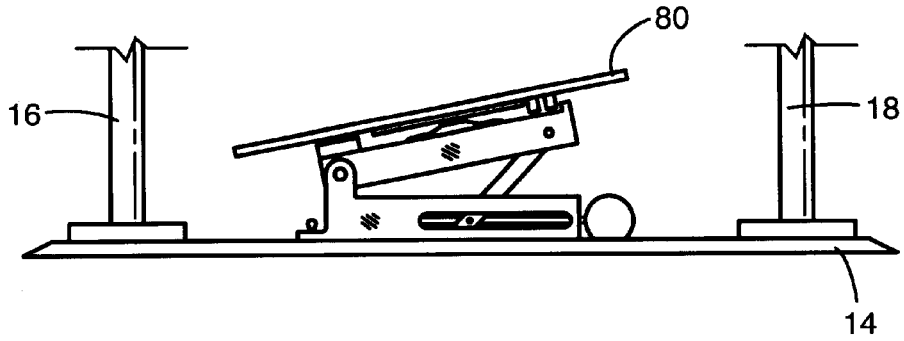
FIG. 7 is a rear view illustrating a sidewardly tilted platform.

In FIG. 5, which is a view from the rear of the apparatus 10 shown in FIG. 1, the platform mounting apparatus 112 has been actuated to pivot the platform 80 upwardly, and the disk 90 has been rotated to place the platform 80 in a frontwardly tilted position. In FIG. 6, the frame 88 and the attached members have been rotated 180° from the position in FIG. 5, and locked into place by the pin 110 to a rearwardly tilted position. The platform mounting apparatus 112 is in a sideward position in FIG. 7. The platform 80 can be tilted to either side or in a direction having a combination of side and frontward or rearward components. The number of directions in which the platform 80 can be tilted is only limited by the device used to fix it in place once it is rotated to a position. It is preferred that an electric motor rotatingly drives the disk 90, by any suitable mechanism, to its desired position. The pin 110 used in the preferred embodiment then extends through one of many aligning apertures formed in the panel 14. This structure allows the platform 80 to be tilted in the number of directions for which there are apertures in the panel 14. It is, of course, possible to have an infinite number of tilting directions by using an infinitely adjustable fixing mechanism as will become apparent to a person of ordinary skill from the present description.

It is preferred that a platform lock, for example the electromagnet 120 shown in FIG. 3, immobilizes the platform 80 and prevents rotation when actuated. The electromagnet 120 is preferably actuated to engage the platform 80 and lock it in position, by a switch on the control panel 126, in the following two circumstances. First, the electromagnet 120 is used to prevent rotation of the platform 80 while the user is stepping onto the platform 80. The electromagnet 120 prevents the instability which would otherwise result from stepping onto a freely rotatable platform. This is especially important for people suffering from injuries who may not have ordinary balance capabilities and who are unable to sustain a fall. Once the person is on the platform 80 and wants the platform 80 to rotate freely, he or she can switch off the electromagnet 120.

Secondly, the electromagnet 120 can prevent rotation of the platform 80 during some exercise activities. For example, if it is desired that the upper body should be rotated relative to the lower body, the platform 80 can remain static.

Figure 9:
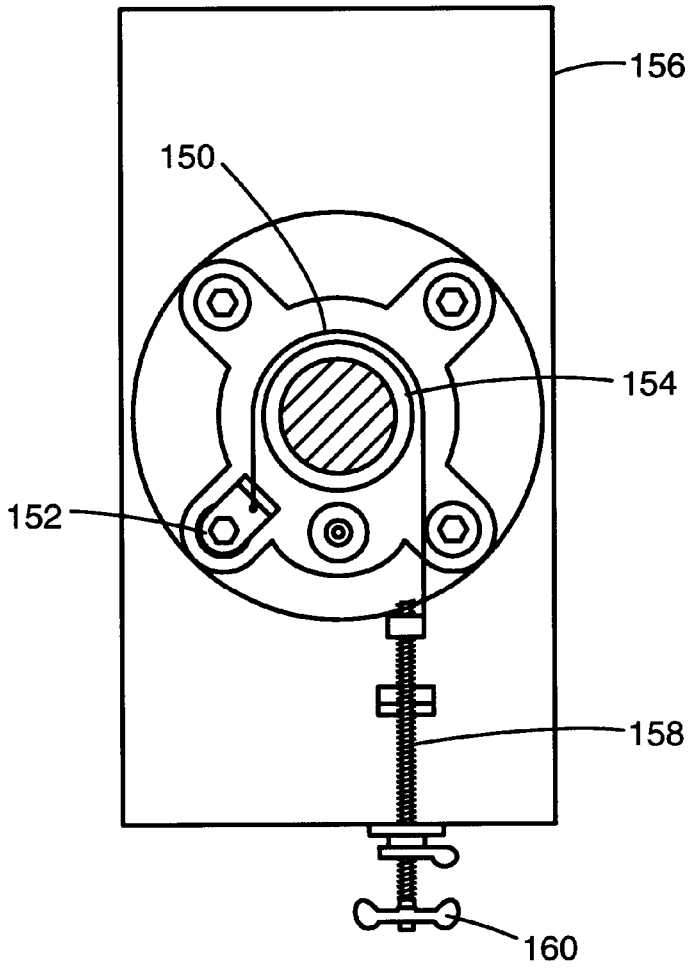
FIG. 9 is a top view illustrating an alternative platform locking and resistance mechanism.
Figure 10:
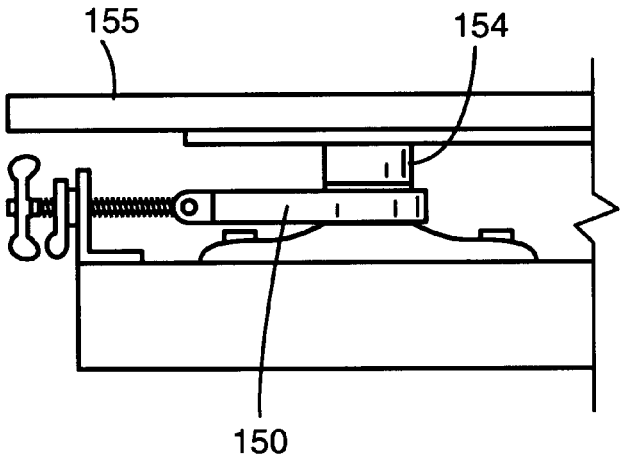
FIG. 10 is a side view of the embodiment of FIG. 9.

Of course, any suitable platform locking mechanism will work, as will become apparent to one of ordinary skill. For example, the embodiment shown in FIGS. 9 and 10 includes a strap 150 extending from an anchor 152 around the shaft 154. The rotatable platform 155 is mounted to the shaft 154, which extends into a bearing in the panel 156. The strap 150 attaches to a threaded rod 158 used for tightening of the strap 150. As the threaded rod 158 is rotated, by rotating the handle 160, the strap 150 tightens around the shaft 154, resisting its rotation. With sufficient tightening, the strap 150 exerts a force against the shaft 154 that effectively locks the shaft 154 from rotating. With less tightening, the strap 150 will exert a smaller force against the shaft 154, thereby merely resisting motion of the rotatable platform 155. The strap 150 is shown in FIG. 10 from the side, illustrating its position relative to the shaft 154.

The degree of rotation of the platform 80 can be limited to certain extremes apart from or in addition to resistance to rotation. This is accomplished by rotation limiters, shown in FIG. 3, comprising the upwardly extending member 120, and the two downwardly extending members 122 and 124. The member 120 extends upwardly from the arm 82 into the path of the downwardly extending members 122 and 124, which mount to the underside of the platform 80. The downwardly extending members 122 and 124 are preferably adjustably attached to the platform 80, and positioned on different sides of the platform 80 from one another. For example, downwardly extending members 122 and 124 are positioned at approximately eleven and one o'clock on the platform 80 in FIG. 3. Upon clockwise rotation of the platform 80, the eleven o'clock member 122 will be displaced along an arcuate path toward, and eventually into contact with, the upwardly extending member 120, stopping the rotation of the platform 80. Upon rotation of the platform 80 in the opposite, counterclockwise direction, the one o'clock member 124 will be displaced in an arcuate path toward the upwardly extending member 120, contacting it and stopping the motion of the platform 80 in that direction.

The downwardly extending members 122 and 124 can preferably be removably attached at regular intervals, such as approximately twenty degrees, along a circle formed on the underside of the platform 80. This spacing permits the user to position the downwardly extending members 122 and 124 to limit the extent of rotation of the platform 80 which limits rotation of the user's spine. This may, for example, be for the purpose of avoiding over rotating the spine during the rotation exercise or graduating the amount of rotation in a safe manner according to each person's tolerance. The members 120–124 are preferably made of steel or other similar material, and preferably incorporate a soft, resilient material such as a rubber bumper to make the impact of the members with one another less audible to the user. Either the members 122 and 124 or the member 120 are detachable so as to be taken out of the way to avoid any limitations upon rotation, if desired.

The preferred embodiment of the present invention operates according to the following description. A human user steps onto the platform 80 and stands thereon while the platform 80 is immobilized, for example by the electromagnet 120. After fastening the harness 60 tightly about the pelvis, the user attaches each of the cables 50–56 to the associated ring on the harness 60. If the handlebar 20 is not at an appropriate height for the user, the pins 38 and 40 are removed by an assistant, and the handlebar 20 is adjusted to the correct height. The height could, of course, be adjusted by the user prior to stepping onto the platform 80. The pins 38 and 40 are then reinserted into position, and the handlebar 20 is locked in place.

The activity undertaken once the user is on the apparatus depends upon the type of exercise desired, but the most fundamental use of the present invention involves merely rotating the waist and hips while the platform 80 remains immobile and the hands stay gripped to the handlebar 20. Rotation of the hips and waist will rotate the harness 60 correspondingly because of its firm attachment to that area of the body. Rotation of the harness displaces the rings 72–75 along arcuate paths, which directs the force that the user applies in rotating along the length of the cables 50–56, thereby raising the weights 42 and 44 a distance proportional to the rotation of the harness 60. Because of the opposite force applied to the harness 60 through the cables by the weights 42 and 44, rotation of the harness 60 is resisted. Therefore, the abdominal oblique, lumbar, and thoracic muscles used to cause the initial rotation of the harness 60 are used to a greater extent than without the resistance of the weights pulling against the harness 60. When the rotation nears its limit and is to be stopped and then reversed, the user uses the same muscle groups to decelerate the action of the torso until the starting position is once again attained. Then rotation of the torso in the opposite direction takes place utilizing the lumbar, thoracic and oblique muscles on the opposite side of the body, in reference to the direction of motion previously described. This exercise of muscles during rotation in both directions enhances both the strength of rotation-effecting muscles, and enhances the controllability of the rotation by utilizing acceleration (concentric) and deceleration (eccentric) actions of the muscles. The use of this concentric and eccentric muscle action enhances rehabilitation and normal movement, because it improves control while improving strength and flexibility in a kinesiologically correct manner.

The user 70 can rotate in both directions from the relaxed position, permitting exercise of all muscles involved in rotation of the lower body relative to the upper body or vice versa. The amount of weight can be varied from virtually nothing by adding no weights to the pick-up bars 46 and 48 to raising all of the weights 42 and 44. The weights can be in any amount or increments, for example, the weights 42 and 44 could include graduated weights in increments of 1 pound up to about 35 pounds for the entire stack. However, these amounts can vary significantly.

An important feature of the present invention is the ability of the platform 80 to be tilted as described above in any direction and to any desirable degree. This causes a user's spine to bend in the direction desired and to the degree desired to isolate the use of individual segments of the spine and muscles of the body plus bending of the spine so that a particular type of motion can be simulated. The motion, when the platform is tilted, emphasizes components in all three planes, and the degree of motion in each plane can be adjusted. The advantages of this feature will be apparent to physical therapists and others with skill in the field of human anatomy and kinesiology.

If a greater degree of mobility is desired other than when the platform 80 is locked in position, the platform 80 can be released to rotate freely (or rotate under a varied degree of resistance). Predetermined limitations can also or alternatively be placed upon the extent of rotation by positioning the limiter members 120, 122 and 124 into conflicting paths. The platform 80 can freely rotate when it is horizontally directed, and when it is tilted (regardless of the direction of tilting). By permitting tilting in any direction and to virtually any degree, the present invention can be used to simulate actual motion of the spine and torso muscles to isolate portions of the spine and torso muscles most in need of activity. This means motions commonly occurring in sports such as tennis, baseball, golf and skiing can be simulated. Also, motions found in occupations, such as grasping an object while lifting and rotating can also be simulated. All of this can be done with no resistance, a small resistance, or significant resistance.

Figure 8:
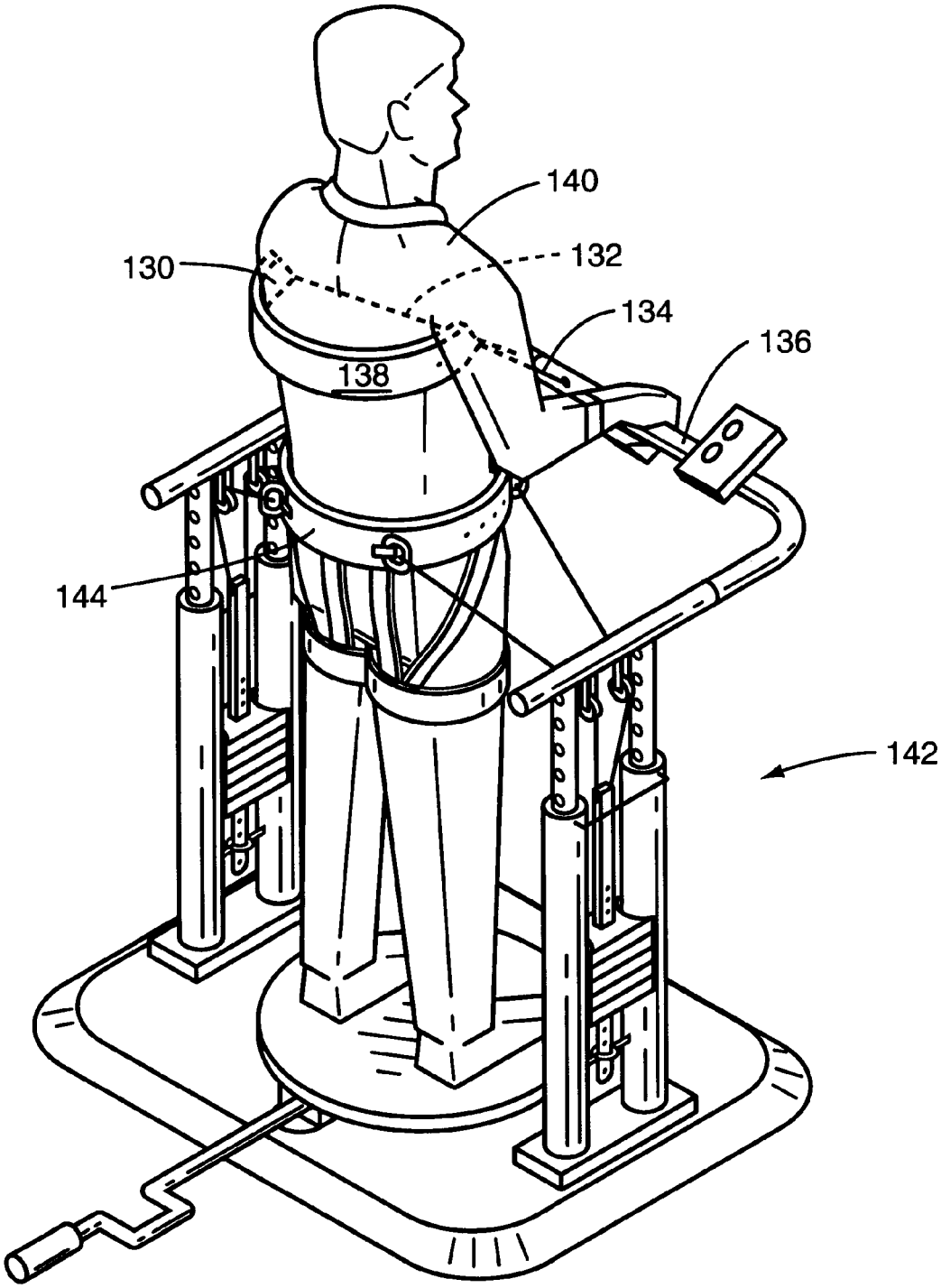
FIG. 8 is a view in perspective illustrating the torso restrictor in use.

A torso stabilizer 130, which is used for immobilizing parts of the torso, is shown in FIG. 8 connected at one end by cables 132 and 134 attached to the handgrippable handle 136. The torso stabilizer 130, which could alternatively be attached to the base 12, includes a belt 138 which extends around the torso of the user 140. The ends of the belt 138 are held in place rotationally by the cables 132 and 134, and because of the high friction grip of the belt 138 against the user, the torso stabilizer 130 prevents the portion of the user 140 to which it is connected from rotating with respect to the handgrippable handle 136. By positioning the torso stabilizer 130 precisely, the portion of the spine below or above the stabilizer which is to be exercised can be isolated. The torso stabilizer 130 and the harness 144 can be reversed from their positions shown in FIG. 8 if it is desired for the upper portion of the torso to have only some moveable resistance against motion and the lower portion of the torso to be restricted in its motion. The torso stabilizer 130 can be positioned anywhere between the thighs and the shoulders to limit motion of the user's torso with respect to the portion to which the harness 144 is attached. However, due to the differences in shape and size of the anatomy at these points, a different harness is preferably used at the pelvis than at the chest. It is also preferred, although not required, that a different torso stabilizer is also used at the pelvis than at the chest. The preferred belt 138 is approximately 3–6 inches wide and extends at least around the back and sides of the user 140 when used at the chest. In the position shown in FIG. 8, the torso stabilizer 130 limits excessive thoracic motion above the harness 144 during rotational movement of the hips and waist.

Figure 11:
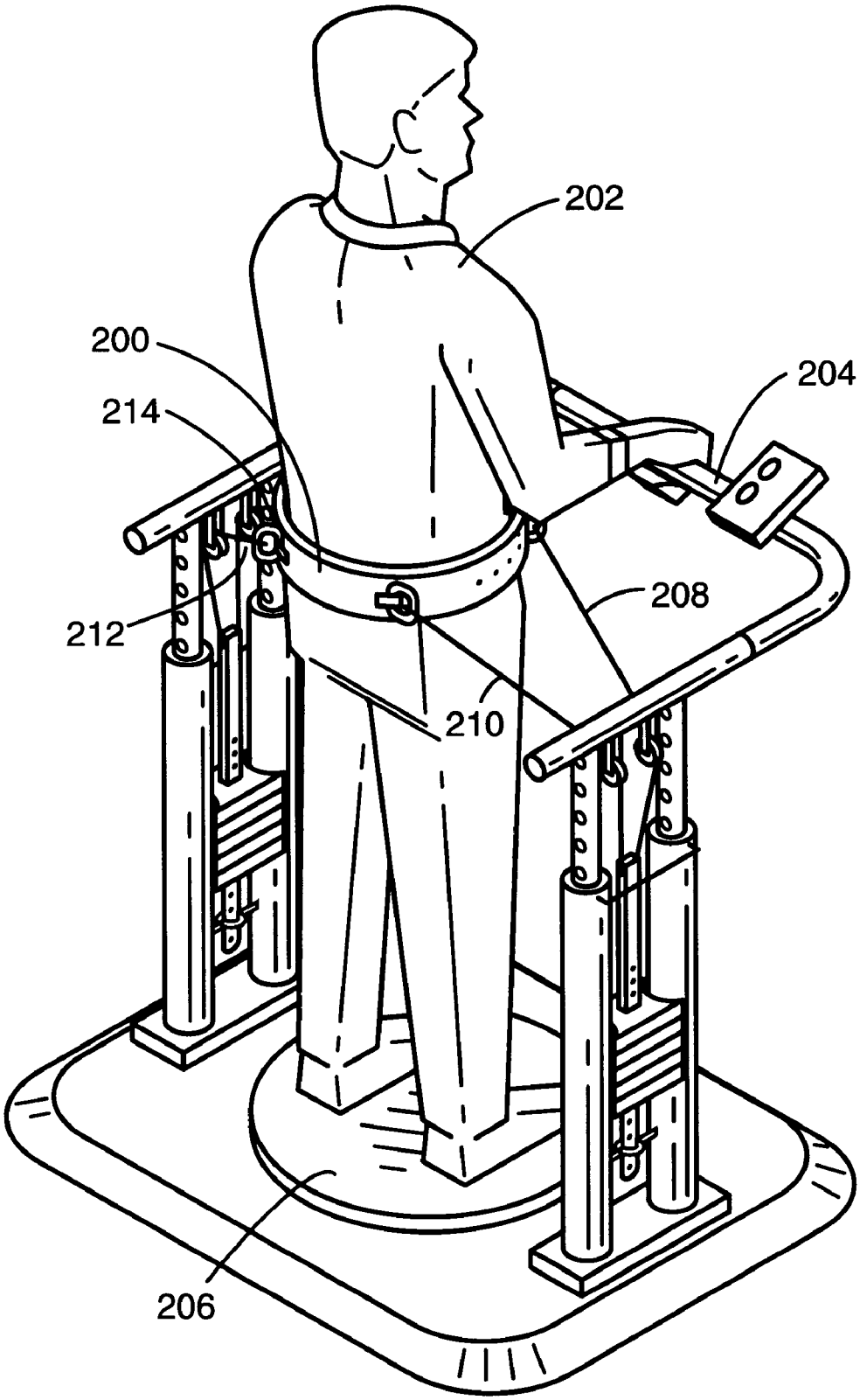
FIG. 11 is a view in perspective illustrating a user in an operable position relative to the invention.
Figure 12:
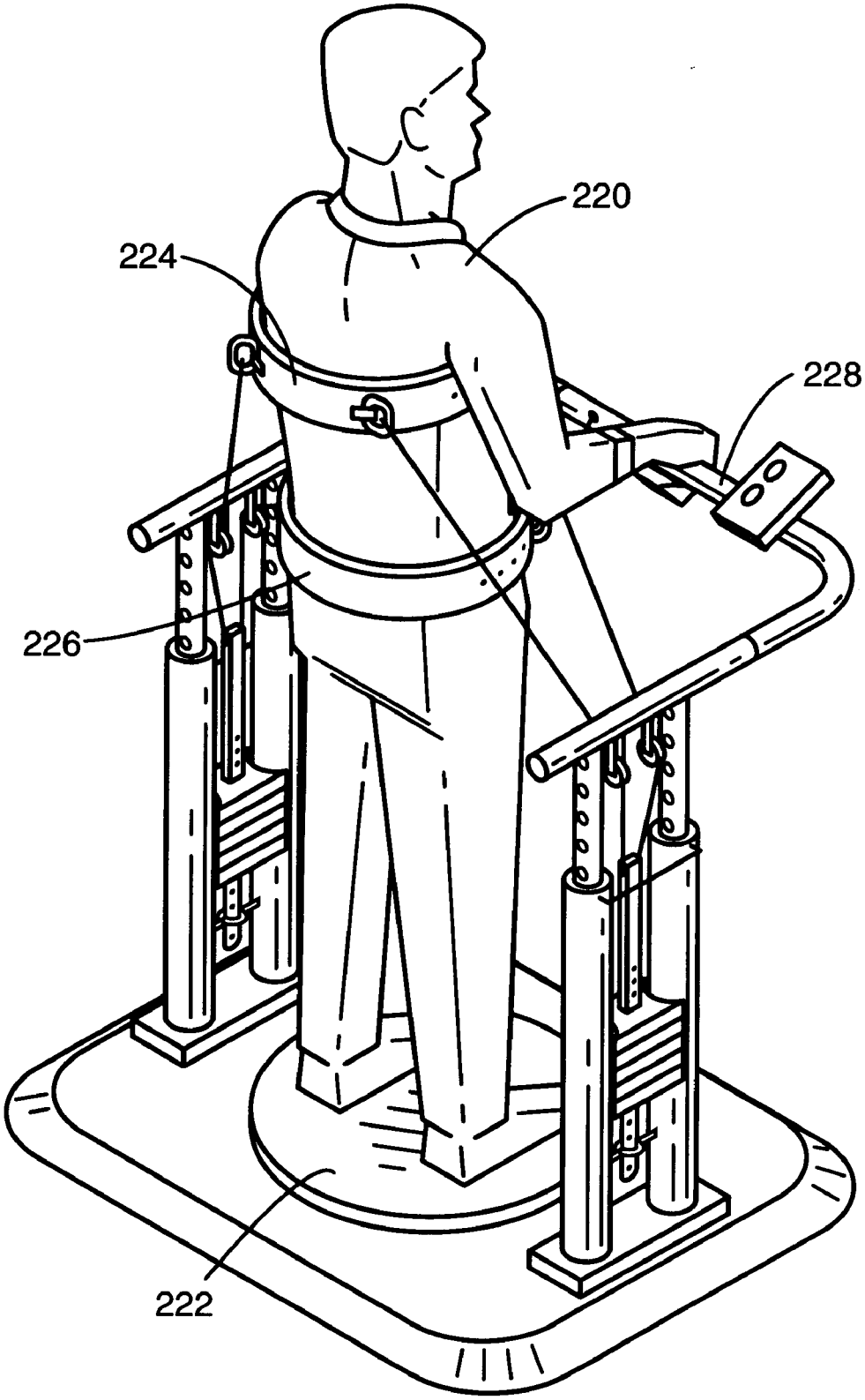
FIG. 12 is a view in perspective illustrating a user in an operable position relative to the invention.

Two examples of ways the exercise apparatus of the present invention is operated and the muscles which are used in concentric and eccentric action, include the uses shown in FIGS. 11 and 12. In FIG. 11, the harness 200 is attached to the user 202 in the preferred position, around the user's waist. The user 202 holds onto the handgrippable handlebar 204 to hold the upper torso relatively fixed with respect to the lower torso, hips and legs. With the platform 206 essentially parallel to the ground, the user 202 rotates his pelvis counterclockwise (to the left). The left external oblique and right internal oblique muscles work concentrically to pull the pelvis to the left, and work eccentrically to control the return motion of the pelvis in the clockwise direction, back to the relaxed position. The right external oblique muscle also works eccentrically to control the counterclockwise acceleration of the pelvis, as does the left internal oblique. The left multifidus and rotatores works concentrically to pull the pelvis counterclockwise and then works eccentrically to control the return motion (clockwise) to the relaxed position. The right multifidus and rotatores work eccentrically to control acceleration of the pelvis in the counterclockwise direction. The left erector spinae (iliocostalis lumborum) muscles work concentrically helping to assist counterclockwise vertebral rotation and extension when the pelvis is moving leftwardly, and eccentrically on the return motion to the initial position. The right erector spinae muscles work eccentrically, controlling acceleration of the spine counterclockwise.

The tilting of the platform 206 does not affect the concentric and eccentric actions of the muscles. However, tilting the platform 206 allows the muscles to assist the user's motion to a greater or lesser extent due to the different angle of the muscles and spinal segments with respect to the cable which is pulled by the muscles. Additionally, changing the tilting of the platform 206 allows emphasis upon the motion of the spine in one plane relative to another, and also affects the amount of rotation and side bending which occur at each spinal segment. Furthermore, rotation in the clockwise direction from the relaxed position shown in FIG. 11 can be undertaken with a similar, although opposite, effect due to the symmetric positioning of the cables 208, 210, 212, and 214.

A second example is shown in FIG. 12 in which a user 220 stands upon the rotatably mounted platform 222, which is locked in position to prevent rotation. The thoracic harness 224 is fixed around the user's chest, and the torso stabilizer 226 is fixed around the user's pelvis, attaching to the handgrippable handlebar 228.

Although the user 220 is shown gripping the handgrippable handlebar 228 before beginning the activity, with the set up shown in FIG. 12, the user 220 will leave his hands free of the handlebar 228 during use. Additionally, the handle 228 is shown at its lowered height, but can be raised to chest height, raising the pulleys, cables, etc. which aids in keeping cables away from body parts. As the user 220 rotates his chest counterclockwise, the right external oblique and left internal oblique work concentrically to rotate the thorax to the left and eccentrically to control the return motion of the thorax to the relaxed position. The left external oblique and the right internal oblique muscles work eccentrically to control the acceleration of the thorax counterclockwise. The right multifidus and rotatores assist in rotation by concentrically pulling the thorax counterclockwise and eccentrically controlling the return motion back to the relaxed position. The left multifidus and rotatores eccentrically control acceleration of the thorax in the counterclockwise direction. The left erector spinae work concentrically in assisting counterclockwise thorax rotation and eccentrically on return motion of the thorax. The right erector spinae work eccentrically controlling acceleration of the spine in the counterclockwise direction. The degree of tilting of the platform 222 has the same effect on the muscles and the spine as in the previous example.

Figure 13:
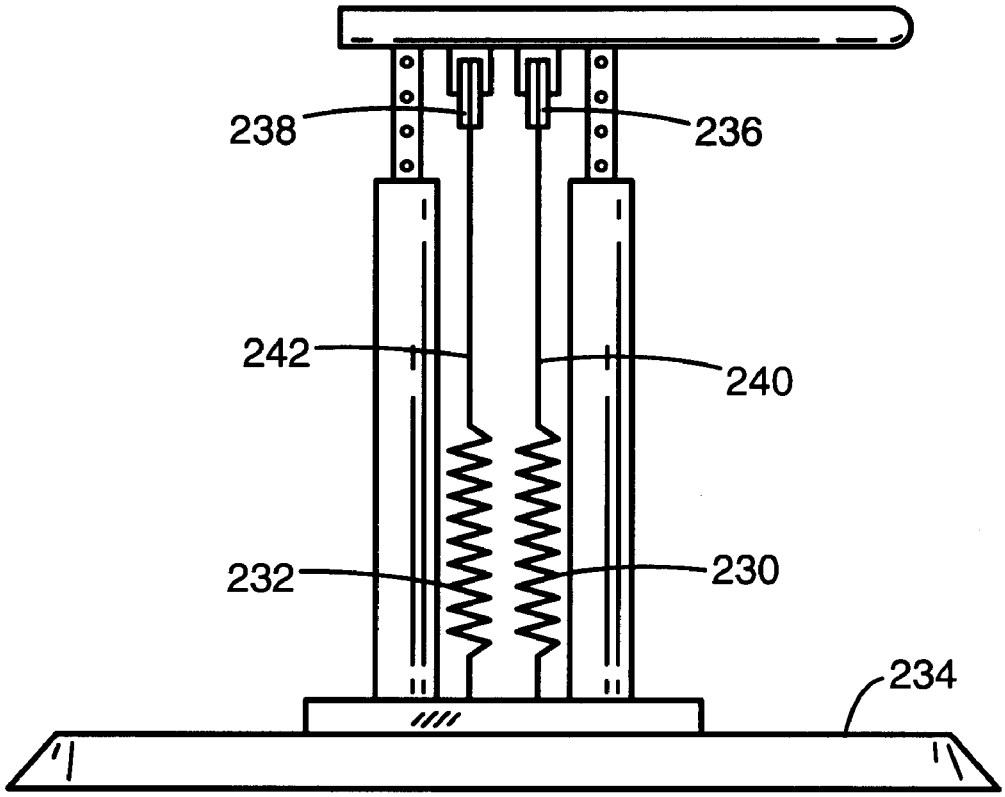
FIG. 13 is a side view illustrating an alternative mechanical force resistor.

In addition to the preferred mechanical force resistor shown in FIG. 1, i.e. the stacks of weights 42 and 44, other mechanical force resistors are contemplated. For example, in the embodiment shown in FIG. 13, the springs 230 and 232 attach to the base 234 extending upwardly toward the pulleys 236 and 238. The springs 230 and 232 function in a similar manner to the stacks of weights 42 and 44 shown in FIG. 1, inasmuch as the springs 230 and 232 resist upward displacement of the attached cables 240 and 242. The resistance force exerted by the springs 230 and 232, however, may not be constant, since most springs have an increasing force applied as the spring is displaced. The springs 230 and 232 can be conventional coil springs, elastomeric bands, or fluid springs. Of course, the springs 230 and 232 could equivalently be electromagnetic or any other type of spring or other bias which resists displacement of the harness when attached to the harness as described in relation to the preferred mechanical force resistor.

In addition to the weights 42 and 44, additional weights may be mounted to the base 12, just outward of the weights 42 and 44, and connected to the thoracic harness 224 shown in FIG. 12. This would permit varying degrees of resistance to be applied to the thorax independent of the resistance applied to the pelvis.

In the preferred embodiment, a bias, such as the weights 42 and 44 under the force of gravity, is used to provide a positive resistance to rotational motion in one direction, and then a negative resistance to rotational motion in the opposite direction. It is possible, in the alternative by, for example, using a dashpot device, to create a positive resistance to rotation from the relaxed position to the extreme position and a positive resistance in the opposite direction back to the relaxed position. With this alternative embodiment, a force in one direction is required to rotate from the relaxed position to the extreme position, and in order to return back to the initial, relaxed position, an opposite force is required. The dashpot force resistance device is not preferred due to the disadvantage of not simulating normal movement. The body normally moves by accelerating (concentric) and decelerating (eccentric) actions. Dashpot devices take away the eccentric component of movement which is necessary for proper rehabilitation, strength and coordination effects. However, the dashpot device is an alternative to the preferred spring bias device under some circumstances.

It is possible to place a box-like structure over the rotating platform to permit a user to swing a baseball bat, tennis racquet, etc. while the harness or harnesses are in place on the user. This allows the user's bat or racquet to pass over the handlebar, and would eliminate any rotational or tilting action of the platform. This may be desired for some users. Alternatively, the handlebar could be designed to be lowered out of the way of swinging arms and racquets.

The force applied to the harness can be sensed and then converted into an electronic signal. The signal can be inputed to a computer for analysis or for record-keeping purposes or for the purpose of actuating another structure, in the manner of a feedback loop. For example, sensors for measuring force can be mounted to each cable of the cable/weight system. The outputs from the sensors are sent to the computer, which is connected to a prime mover, such as a motor. The motor, in response to the computer's signal, actuates a gate or a gated gas spring connected to the cables. With this device, the resistance measured at the cables can affect the spring constant of the mechanical force resistor (i.e. the gas spring).

An alternative mechanism for locking the rotation of the platform which also serves to resist the motion of the platform is shown in FIG. 14. In this drawing, a brake is engaged with the underside of the rotatable platform to varying degrees, from minimal contact providing minimal resistance to rotation, up to a significant amount of pressure exerted by the brake pad onto the underside of the rotatable platform. This is accomplished by rotating the handle which pivots the swing arm pointer upwardly engaging the brake pad with the underside of the rotatable platform with varying degrees of force. The high friction brake pad frictionally engages the underside of the rotatable platform and the resistance is a function of the force applied to the brake pad in its engagement with the underside of the platform.

While certain preferred embodiments of the present invention have been disclosed in detail, it is to be understood that various modifications may be adopted without departing from the spirit of the invention or scope of the following claims.

We claim:

1. An exercise apparatus for a human user's body, the apparatus comprising:

(a) a platform adapted to receive a weight bearing portion of the user's body;

(b) a platform mounting apparatus for adjustably tilting the platform relative to a base, the platform mounting apparatus including an elongated arm pivotally mounted to the base, said platform being rotatably connected to the arm;

(c) a mechanical force resistor connected to the base; and (d) a harness connected to the mechanical force resistor for attaching to the user's torso so as to resist twisting motion of the user's torso.

2. An exercise apparatus in accordance with claim 1, wherein said elongated arm is pivotably mounted to a frame, the frame being rotatably mounted to said base.

3. An exercise apparatus in accordance with claim 2, wherein said platform's axis of rotation is fixed transverse to the arm for tilting said axis upon pivoting of said arm.

4. An exercise apparatus in accordance with claim 1, further comprising a torso stabilizer connected to the base, for attaching to the user's torso and limiting motion of the torso.

5. An exercise apparatus in accordance with claim 1, further comprising a handgrippable handle connected to the base.

6. An exercise apparatus in accordance with claim 5, further comprising a torso stabilizer connected to the handgrippable handle, for attaching to the user's torso and limiting motion of the torso.

7. An exercise apparatus in accordance with claim 5, wherein said handgrippable handle is vertically adjustable relative to the platform.

8. An exercise apparatus in accordance with claim 1, wherein the mechanical force resistor comprises at least one massive body connected to the harness by a cable extending through a pulley.

9. An exercise apparatus in accordance with claim 8, the mechanical force resistor further comprising a first cable pair extending from attachment to a first massive body through a first pair of pulleys and attaching to a left side of said harness at two spaced locations, and a second cable pair extending from attachment to a second massive body through a second pair of pulleys and attaching to a right side of said harness at two spaced locations.

10. An exercise apparatus in accordance with claim 1, wherein the mechanical force resistor comprises at least one spring.

11. An exercise apparatus in accordance with claim 1, further comprising at least one platform rotation limiter mounted to the base and in a path of rotation of the platform, for contacting and ceasing rotation of the platform.

12. An exercise apparatus in accordance with claim 1, further comprising at least one platform rotation limiter mounted to the platform, for contacting the elongated arm during rotation of the platform, ceasing rotation of the platform.

13. An exercise apparatus in accordance with claim 1, further comprising a platform lock connected to the base and the platform, for resisting rotation of the platform.

14. An exercise apparatus in accordance with claim 13, wherein the platform lock comprises an electromagnet.

* * * * *